US006189828B1

(12) United States Patent
Reilly

(10) Patent No.: US 6,189,828 B1
(45) Date of Patent: Feb. 20, 2001

(54) SANITARY PAPER ROLL DISPENSER

(76) Inventor: Robert Reilly, 73-440 Little Bend Trail, Palm Desert, CA (US) 92260

( * ) Notice: Under 35 U.S.C. 154(b), the term of this patent shall be extended for 0 days.

(21) Appl. No.: 09/436,177

(22) Filed: Nov. 8, 1999

(51) Int. Cl.[7] ..... B65H 18/04
(52) U.S. Cl. ..... 242/596.4; 242/596.7
(58) Field of Search ..... 242/596.3, 596, 242/596.4, 596.5, 596.8, 598.2, 598.1, 596.6, 596.7, 599.2, 599.3, 599.4

(56) References Cited

U.S. PATENT DOCUMENTS

| | | | | |
|---|---|---|---|---|
| 1,913,363 | * | 6/1933 | Allen | 242/596.4 |
| 1,987,154 | | 1/1935 | Noffsinger . | |
| 2,643,069 | * | 6/1953 | Carlin | 242/596.4 |
| 3,823,889 | | 7/1974 | Johnson et al. . | |
| 4,452,403 | * | 6/1984 | Arronte | 242/596.4 |
| 4,553,710 | * | 11/1985 | Pool | 242/596.4 |
| 4,662,576 | * | 5/1987 | Paul | 242/596.4 |
| 5,253,818 | * | 10/1993 | Craddock . | |
| 5,653,403 | | 8/1997 | Ritchey . | |
| 5,720,447 | | 2/1998 | Brechko . | |
| 5,813,624 | | 9/1998 | Grasso . | |
| 5,868,347 | * | 2/1999 | Paul et al. | 242/596.4 |

* cited by examiner

*Primary Examiner*—Donald P. Walsh
*Assistant Examiner*—William A. Rivera

(57) ABSTRACT

A toilet paper dispenser which serves the dual role of providing paper roll support arms and a shields for the cavity in the support arms. When a paper roll is inserted into the dispenser, the edge of the roll contacts the shields pushing the shields into the cavities and when the paper roll tube bore reaches the shields, the shields become re-positioned in the bore of the paper roll by a tensioning device.

14 Claims, 9 Drawing Sheets

SANITARY PAPER ROLL DISPENSER

BACKGROUND OF THE INVENTION

1. Field of the Invention

The present invention relates generally to paper dispensers and, more specifically, to a sanitary paper dispenser having tensioned pivotal cavity shields which serve the dual purpose of providing tensioning means for the paper roll support arms and closure means for the cavity which exists in mechanisms having pivotal paper roll support arms. As a paper roll is inserted into a pivotal arm dispenser, the paper roll causes the support arms to pivot into a cavity within the dispensers housing until the arms which are under tensioning means, return to the extended position upon encountering the hollow area of the roll. The present invention prevents the introduction of particle matter by having pivotal partitions which in an at rest position provide solid cantilevered support walls for said paper roll support arms until such time as it is necessary to insert or replace the paper roll. The pivotal cavity shield not only adds to the aesthetic quality of the paper dispenser but will also prevent the introduction of particle matter into said cavity therein providing a sanitary paper roll dispenser.

2. Description of the Prior Art

There are other paper roll dispensers designed for rolled paper. Typical of these is U.S. Pat. No. 1,987,154 issued to Noffsinger on Jan. 8, 1935.

Another patent was issued to Grasso et al. on Sep. 29, 1998 as U.S. Pat. No. 5,813,624. Yet another U.S. Pat. No. 5,720,447 was issued to Brechko on Feb. 24, 1998. Still yet another was issued on Aug. 5, 1997 to Ritchey as U.S. Pat. No. 5,653,403 and another patent was issued to Johnson et al. on Jul. 16, 1974 as U.S. Pat. No. 3,823,889.

U.S. Pat. No. 1,987,154

Inventor: George E. Noffsinger

Issued: Jan. 8, 1935

This United States Patent discloses devices for a supporting toilet paper roll. Said devices are comprised of resilient non-metallic holders comprising a pair of resilient soft rubber supporting arms provided with confronting trunnions adapted to carry the paper roll.

U.S. Pat. No. 5,813,624

Inventor: Kamala J. Grasso et al.

Issued: Sep. 29, 1998

Apparatus for dispensing toilet tissue alternately from two rolls includes a housing and roll support spindles for supporting the rolls in coaxial spaced relationship relative to the housing. A sliding cover is slidably positioned on the housing. The roll support spindles are mounted on a pivoted support frame and a pivoted plate depends from the support frame and is located in the space between adjacent roll ends. The cover includes detents which cooperate with the pivoted plate to allow sliding of the cover on the housing to expose a different roll of toilet paper only when one of the rolls is substantially depleted.

U.S. Pat. No. 5,720,447

Inventor: Michael Richard Brechko

Issued: Feb. 24, 1998

A web guiding device for directing sheet material from a supply roll into a processing machine along a predetermined track in a manner that corrects for tracking errors caused by side edge-to-edge variations in the force needed to draw the sheet material from the supply roll. The web guiding device includes a support frame that retains the supply roll in a manner that enables the supply roll to freely rotate about its mid-axis as the sheet material is drawn from the supply roll. The support structure is pivotally mounted to a bracket structure that couples the support structure to the processing machine. At least one guide element is provided on the bracket structure for orienting the sheet material onto the predetermined track prior to the sheet material being received by the processing machine. The support frame and the supply roll are canted when a side edge-to-side edge variation is experienced in the force needed to draw the sheet material from the supply roll. The canting of the supply structure at least partially compensates for the side edge-to-side edge force variations experienced, thereby helping to maintain the sheet material on the predetermined track.

U.S. Pat. No. 5,653,403

Inventor: Eugene B. Ritchey

Issued: Aug. 5, 1997

In a first embodiment, the toilet paper holder and dispenser includes a rod receiving section adapted to receive the dispenser rod of a common toilet paper dispenser. A peg attaches to the rod receiving section and protrudes away therefrom. A stabilizer is also attached to the rod receiving section to prevent the toilet paper holder from undesirably rotating and shifting when toilet paper is dispensed from the roll which is mounted over the peg. In a second embodiment, the peg may be adjustably positioned at a desired vertical angle. In a third embodiment, the toilet paper holder includes a recessed mounting bracket which is directly mountable to the recess formed in the wall previously had mounted to it the common toilet paper dispenser. For any one of the embodiments, the distal end of the peg may include either a tip portion which is angled or bent away from the longitudinal axis of the peg or may include a retainer or cap to assist in retaining a roll of toilet paper mounted over the peg.

U.S. Pat. No. 3,823,889

Inventor: Leland R. Johnson et al.

Issued: Jul. 16, 1974

A spring loaded easy-on easy-off toilet paper holder consisting of a base having a pair of arms extending at right angles from the base and longitudinally spaced apart, one of the arms being hinged to the base by a spring loaded hinge normally urging the arm into the normal position with a toilet paper holding spool projecting perpendicular from the end of the hinged arm in the direction of the other arm, the other of the arms being fixedly mounted on the base and aligned with the first arm and adapted to receive and retain the free end of the toilet paper holding rod projecting from the hinged arm such that a roll of toilet paper may be easily placed onto and removed from the toilet paper holder.

While these paper roll dispensers may be suitable for the purposes for which they were designed, they would not be as suitable for the purposes of the present invention, as hereinafter described.

SUMMARY OF THE PRESENT INVENTION

The present invention discloses a pair of outwardly tensioned pivotal cavity shields positioned on the inner face of the ends of a toilet paper dispenser which serve the dual purpose of providing a paper roll support arm and a closure means for its cavity interior the ends of the toilet paper dispenser. When a paper roll is inserted into the paper dispenser, the outer edge of the paper roll contacts the shields pushing the shields into their cavity and when the paper roll tube bore reaches the shields, the shields become re-positioned inside the bore of the roll of toilet paper by the outwardly tensioning means which means also pivot and are spring-loaded.

A primary object of the present invention is to provide a paper roll dispenser where the roll can be inserted easily with one hand.

Another object of the present invention is to provide a paper roll dispenser having automatic means for moving the paper support mechanism as the paper roll is being inserted.

Yet another object of the present invention is to provide a paper roll dispenser having means for sealing the cavity for the automatic pivotal support arms.

Additional objects of the present invention will appear as the description proceeds.

The present invention overcomes the shortcomings of the prior art by providing a sanitary paper dispenser having tensioned pivotal cavity shields which serve the dual purpose of providing tensioning means for the paper roll support arms and closure means for the cavity which exists in mechanisms having pivotal paper roll support arms. As a paper roll is inserted into a pivotal arm dispenser, the paper roll causes the support arms to pivot into a cavity within the dispensers housing until the arms which are under tensioning means, return to the extended position upon encountering the hollow area of the roll. The present invention prevents the introduction of particle matter by having pivotal partitions which in an at rest position provide solid cantilevered support walls for said paper roll support arms until such time as it is necessary to insert or replace the paper roll. The pivotal cavity shield not only adds to the aesthetic quality of the paper dispenser but will also prevent the introduction of particle matter into said cavity therein providing a sanitary paper roll dispenser.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
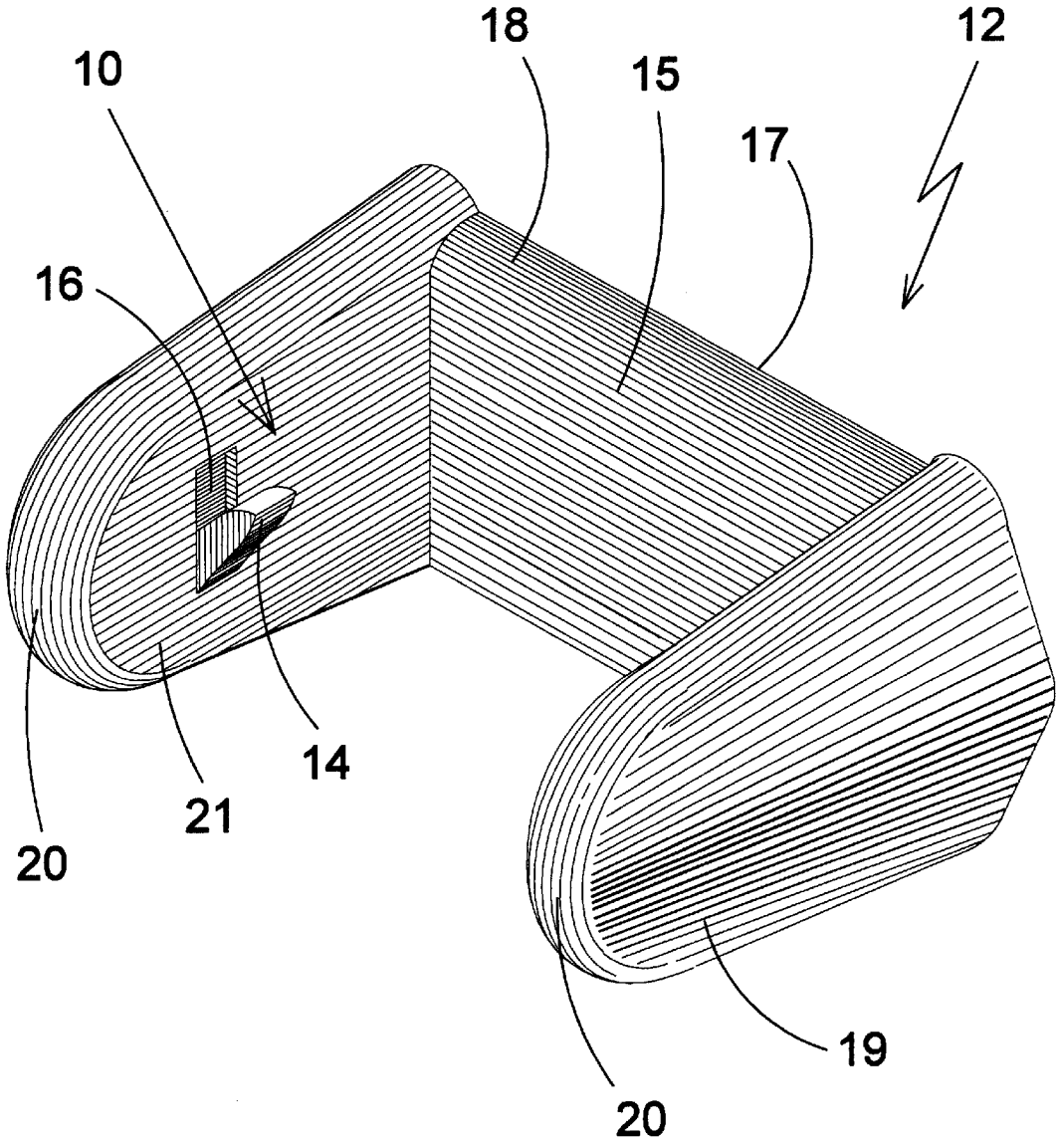
FIG. 1 is a perspective view of the present invention. Shown is a sanitary paper dispenser having tensioned pivotal cavity shields which serve the dual purpose of providing tensioning means for the paper roll support arms and closure means for the cavity which exists in mechanisms having pivotal paper roll support arms. The pivotal cavity shield not only adds to the aesthetic quality of the paper dispenser but will also prevent the introduction of particle matter into said cavity therein providing a sanitary paper roll dispenser.

With regard to reference numerals used, the following numbering is used throughout the drawings.

10 present invention
12 paper dispenser
14 cavity shield
15 front side
16 cavity
17 backside
18 base member
19 outer side
20 end member/housing
21 inner side
22 paper roll
24 tube
26 bore of tube
28 contact point
30 pivots
32 tensioning means
34 pivots
36 spring
38 plate
40 cavity
42 apertures
44 direction arrow
46 angular edges
48 recess

DESCRIPTION OF THE PREFERRED EMBODIMENT(S)

In order that the invention may be more fully understood, it will now be described, by way of example, with reference to the accompanying drawings in which FIGS. 1 through 10 illustrate the present invention being a cavity shield for a sanitary paper roll dispenser.

Turning to FIG. 1, shown therein is a perspective view of the present invention 10. Shown is a sanitary paper dispenser 12 having tensioned pivotal cavity shields 14 which serve the dual purpose of providing the paper roll support arms and closure means for the cavity 16 which exists in mechanisms having pivotal paper roll support arms. The pivotal cavity shield 14 not only adds to the aesthetic quality of the paper dispenser 12 but will also prevent the introduction of particle matter into the cavity 16 therein providing a sanitary paper roll dispenser 12. Dispenser 12 has a rectangular base member 18 having a front side 15 and a back side 17 along with a pair of end members 20 having an outer side 19 and inner side 21 which contain the cavity shields 14. The end members 20 are substantially the same height as the base member 18.

Figure 2:
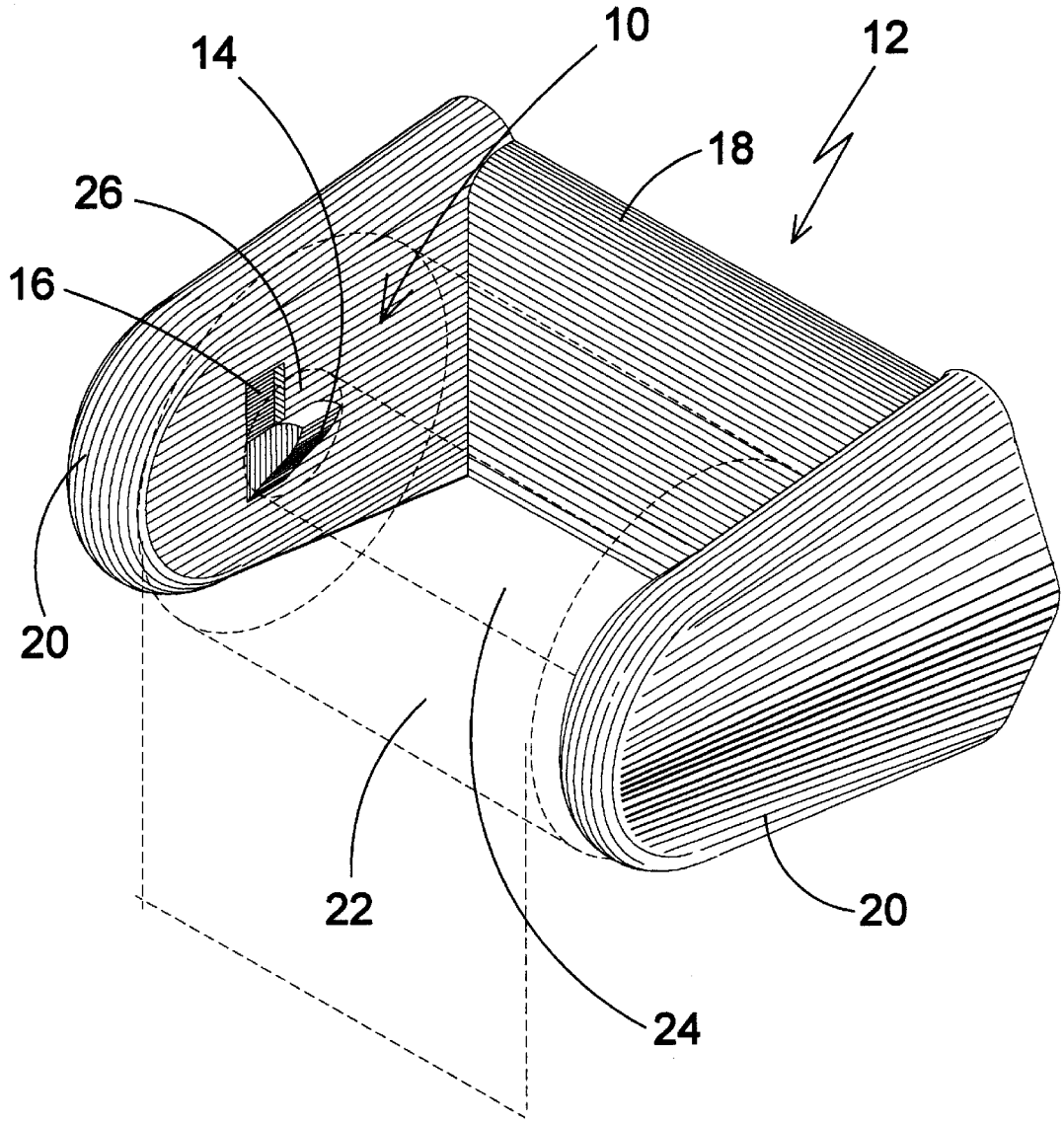
FIG. 2 is a perspective view of the present invention. Shown is a sanitary paper dispenser having tensioned pivotal cavity shields which serve the dual purpose of providing tensioning means for the paper roll support arms and closure means for the cavity which exists in mechanisms having pivotal paper roll support arms. The pivotal cavity shield not only adds to the aesthetic quality of the paper dispenser but will also prevent the introduction of particle matter into said cavity therein providing a sanitary paper roll dispenser. Also shown, in outline, is a roll of paper mounted within the paper dispenser ready to be used.

Turning to FIG. 2, shown therein is a perspective view of the present invention 10. Shown is a sanitary paper dispenser 12 having tensioned pivotal rectangular cavity shields 14 which serve the dual purpose of providing the paper roll support arms and closure means for the rectangularly shaped cavity 16 which exists in mechanisms having pivotal paper roll support arms. The pivotal cavity shield 14 not only adds to the aesthetic quality of the paper dispenser 12 but will also prevent the introduction of particle matter into the cavity 16 therein providing a sanitary paper roll dispenser 12. Also shown, in outline, is a roll of paper 22 mounted within the paper dispenser 12 ready to be used having the inner tube 24 having a bore 26 therein into which the cavity shields 14 are positioned as the paper roll support arms. The base 18 and ends 20 are also shown.

Figure 3:
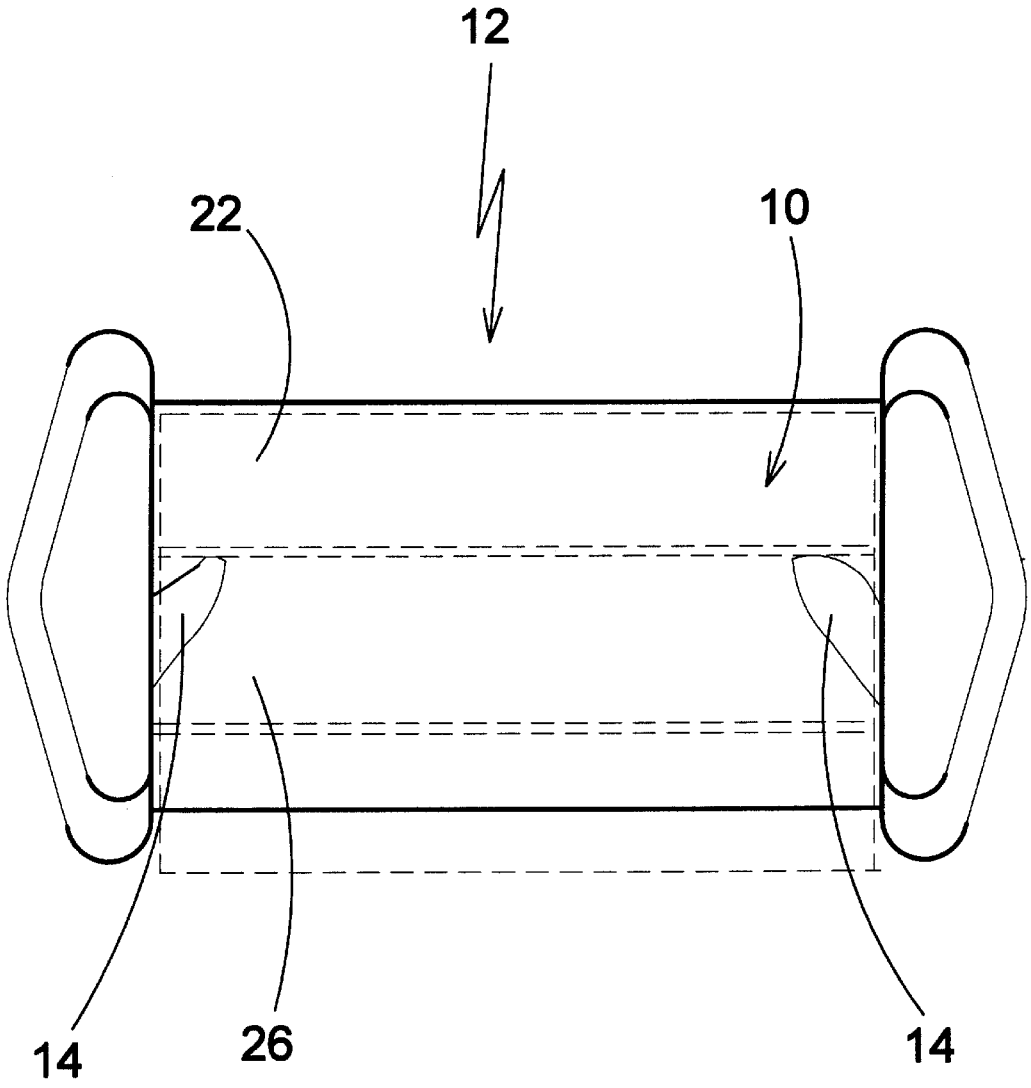
FIG. 3 is a front view of the present invention. Shown are the support arms for the sanitary paper dispenser positioned within the hollow cavity of the paper roll. The present invention prevents the introduction of particle matter by having pivotal partitions which in an at rest position provide solid cantilevered support walls for said paper roll support arms until such time as it is necessary to insert or replace the paper roll.

Turning to FIG. 3, shown therein is a front view of the present invention 10. Shown are the support arms 14 for the sanitary paper dispenser 12 positioned within the hollow cavity 26 of the paper roll 22. The present invention prevents the introduction of particle matter by having pivotal partitions which in an at rest position provide solid cantilevered support walls for the paper roll support arms until such time as it is necessary to insert or replace the paper roll 22.

Figure 4:
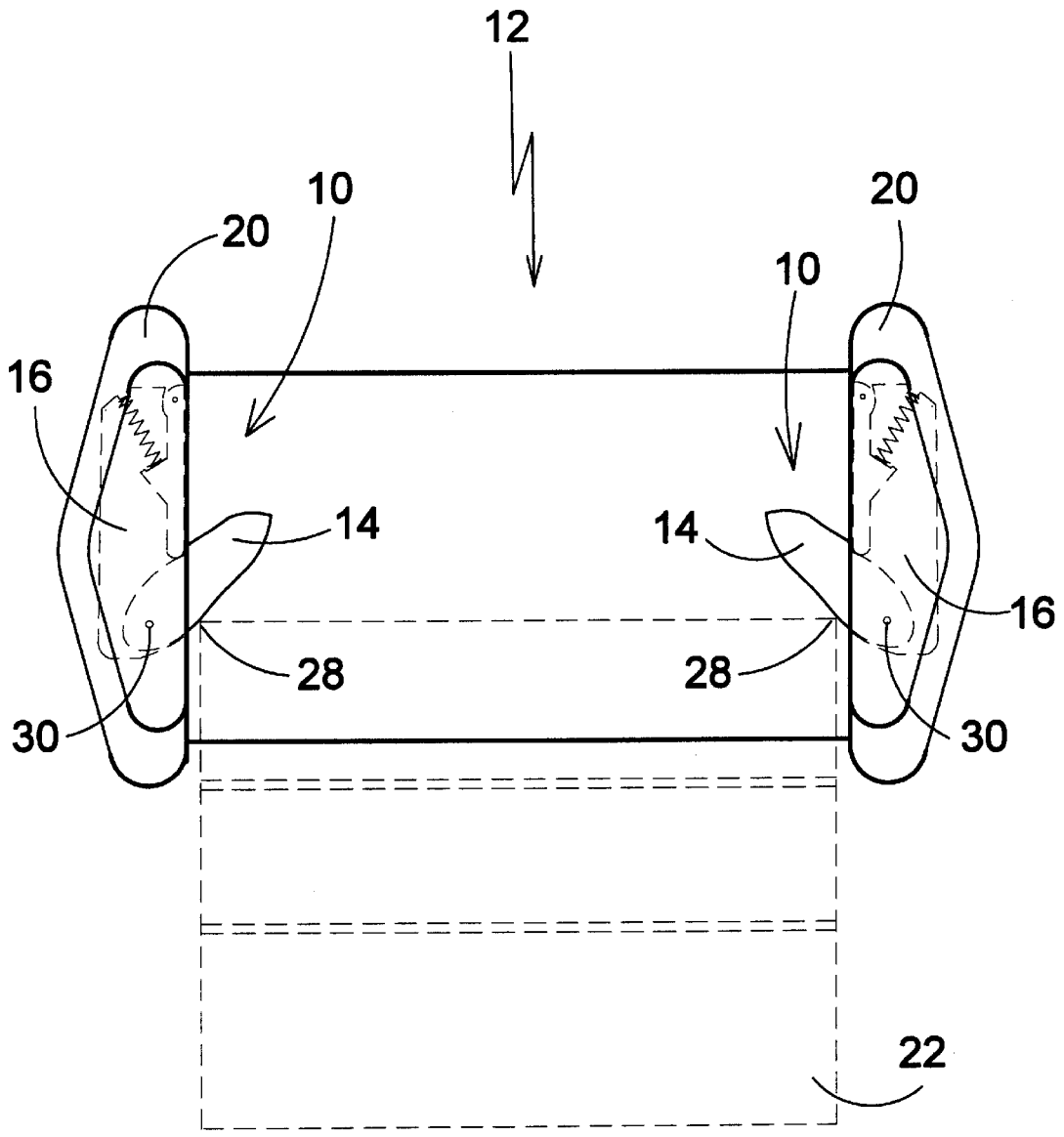
FIG. 4 is a front view of the present invention. Shown is the sanitary paper dispenser having tensioned pivotal cavity shields which serve the dual purpose of providing tensioning means for the paper roll support arms and closure means for the cavity which exists in mechanisms having pivotal paper roll support arms. The pivotal cavity shield not only adds to the aesthetic quality of the paper dispenser but will also prevent the introduction of particle matter into said cavity therein providing a sanitary paper roll dispenser. Also shown is a roll of paper, shown in outline, having a point of contact which will cause the paper roll support arms to be pivoted into the paper dispensing housing arms cavities.

Turning to FIG. 4, shown therein is a front view of the present invention 10. Shown is the sanitary paper dispenser 12 having tensioned pivotal cavity shields 14 with pivots 30 on the lower ends thereof which serve the dual purpose of providing the paper roll support arms and closure means for the cavity 16 which exists in mechanisms having pivotal paper roll support arms 14. The pivotal cavity shield 14 not only adds to the aesthetic quality of the paper dispenser 12 but will also prevent the introduction of particle matter into the cavity 16 therein providing a sanitary paper roll dispenser 12. Also shown is a roll of paper 22, shown in outline, having a point of contact 28 which will cause the paper roll support arms 14 to be pivoted into the paper dispensing arms cavities 16 contained within the ends or housing 20.

Figure 5:
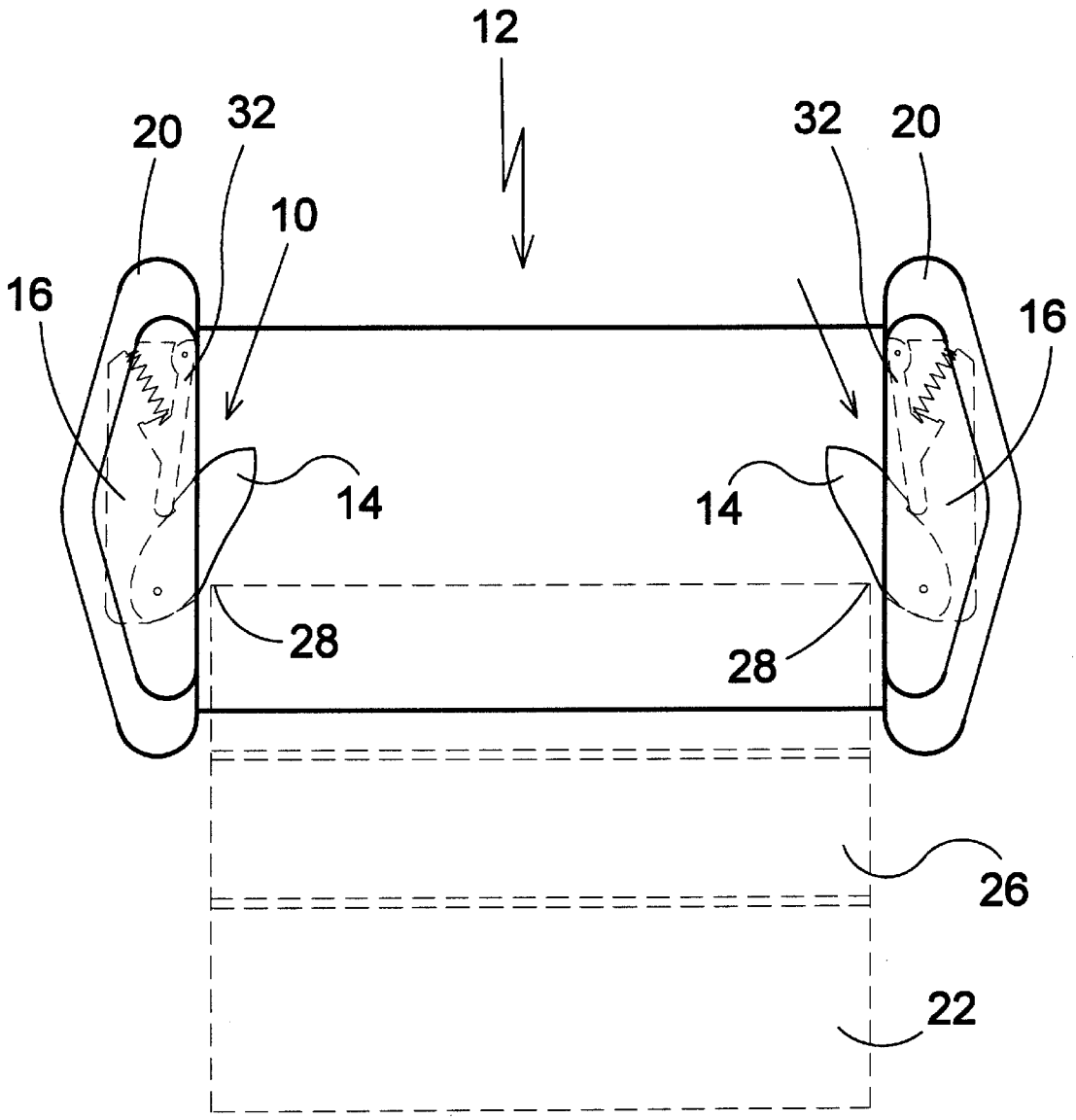
FIG. 5 is a front view of the present invention. Shown is the sanitary paper dispenser having tensioned pivotal cavity shields which serve the dual purpose of providing tensioning means for the paper roll support arms and closure means for the cavity which exists in mechanisms having pivotal paper roll support arms. As a paper roll is inserted into the dispenser, the paper roll causes the support arms to pivot into a cavity within the dispensers housing until the arms which are under tensioning means, return to the extended position upon encountering the hollow area of the roll. The pivotal cavity shield not only adds to the aesthetic quality of the paper dispenser but will also prevent the introduction of particle matter into said cavity therein providing a sanitary paper roll dispenser.

Turning to FIG. 5, shown therein is a front view of the present invention 10. Shown is the sanitary paper dispenser having tensioned pivotal cavity shields 14 which serve the dual purpose of providing the paper roll support arms and closure means for the cavity 16 which exists in mechanisms having pivotal paper roll support arms. As a paper roll 22 is inserted into the dispenser 12, the paper roll by making contact 28 causes the support arms 14 to pivot inwardly into a cavity 16 within the dispensers housing 20 until the arms 14, which are under outwardly tensioning means 32, return to the extended position upon encountering the hollow area 26 of the roll. The pivotal cavity shield 14 not only adds to the aesthetic quality of the paper dispenser 12 but will also prevent the introduction of particle matter into said cavity 16 therein providing a sanitary paper roll dispenser.

Figure 6:
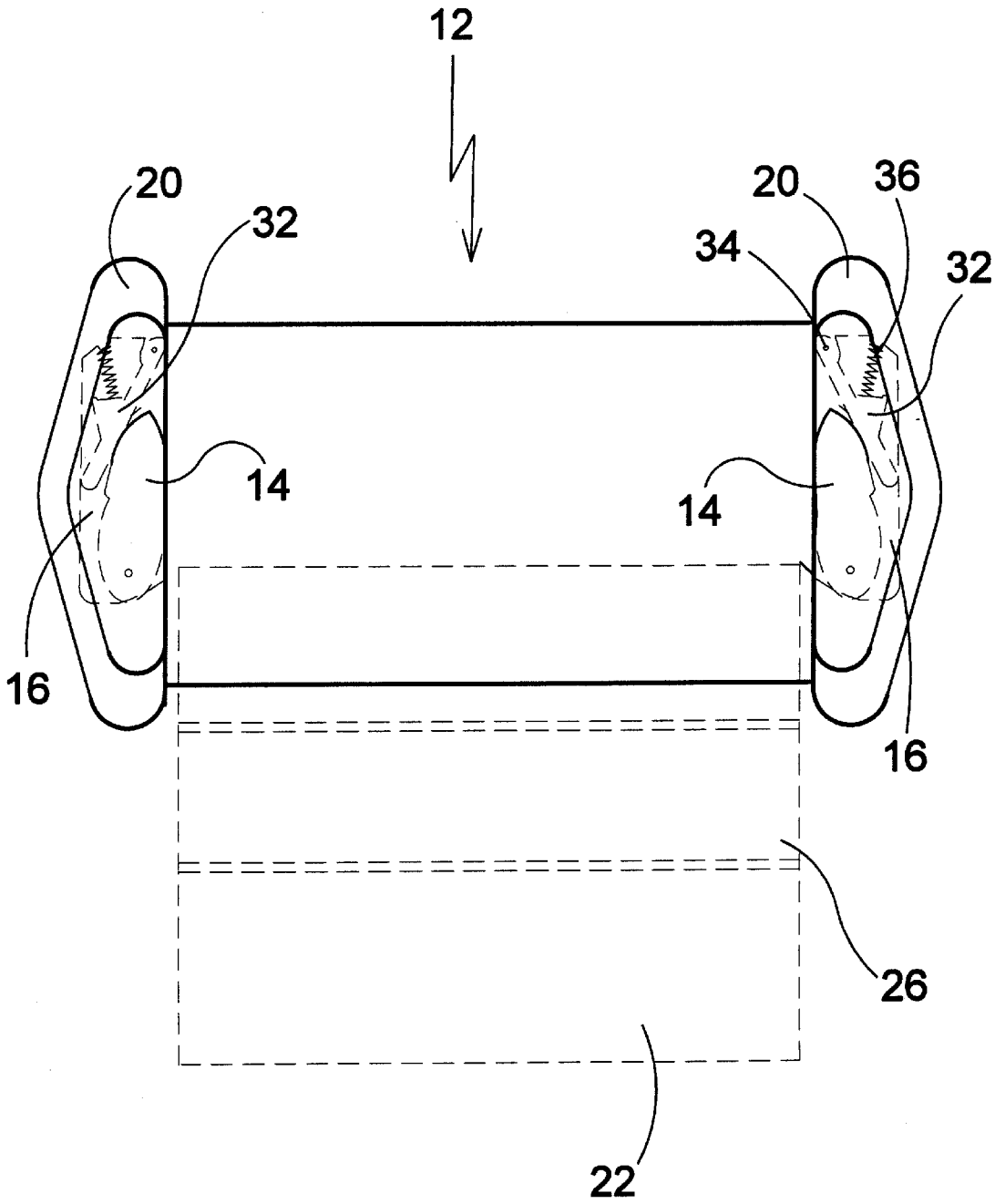
FIG. 6 is a continuation of the installation of a paper roll as shown in FIG. 5. Shown is the sanitary paper dispenser having tensioned pivotal cavity shields which serve the dual purpose of providing tensioning means for the paper roll support arms and closure means for the cavity which exists in mechanisms having pivotal paper roll support arms. As a paper roll is inserted into the dispenser, the paper roll causes the support arms to pivot into a cavity within the dispensers housing until the arms which are under tensioning means, return to the extended position upon encountering the hollow area of the roll. The pivotal cavity shield not only adds to the aesthetic quality of the paper dispenser but will also prevent the introduction of particle matter into said cavity therein providing a sanitary paper roll dispenser.

Turning to FIG. 6, shown therein is a continuation of the installation of a paper roll 22 as shown in FIG. 5. Shown is the sanitary paper dispenser 12 having tensioned pivotal cavity shields 14 which serve the dual purpose of providing the paper roll support arms and closure means for the cavity 16 which exists in mechanisms having pivotal paper roll support arms. As a paper roll 22 is inserted into the dispenser 12, the paper roll 22 causes the support arms 14 to pivot into a cavity 16 within the dispensers housing 20 until the arms 14, which are under tensioning means 32, being pivotal 34 and spring-loaded 36, return to the extended position upon encountering the hollow area 26 of the roll 22. The pivotal cavity shield 14 not only adds to the aesthetic quality of the paper dispenser 12 but will also prevent the introduction of particle matter into the cavity 16 therein providing a sanitary paper roll dispenser 12.

Figure 7:
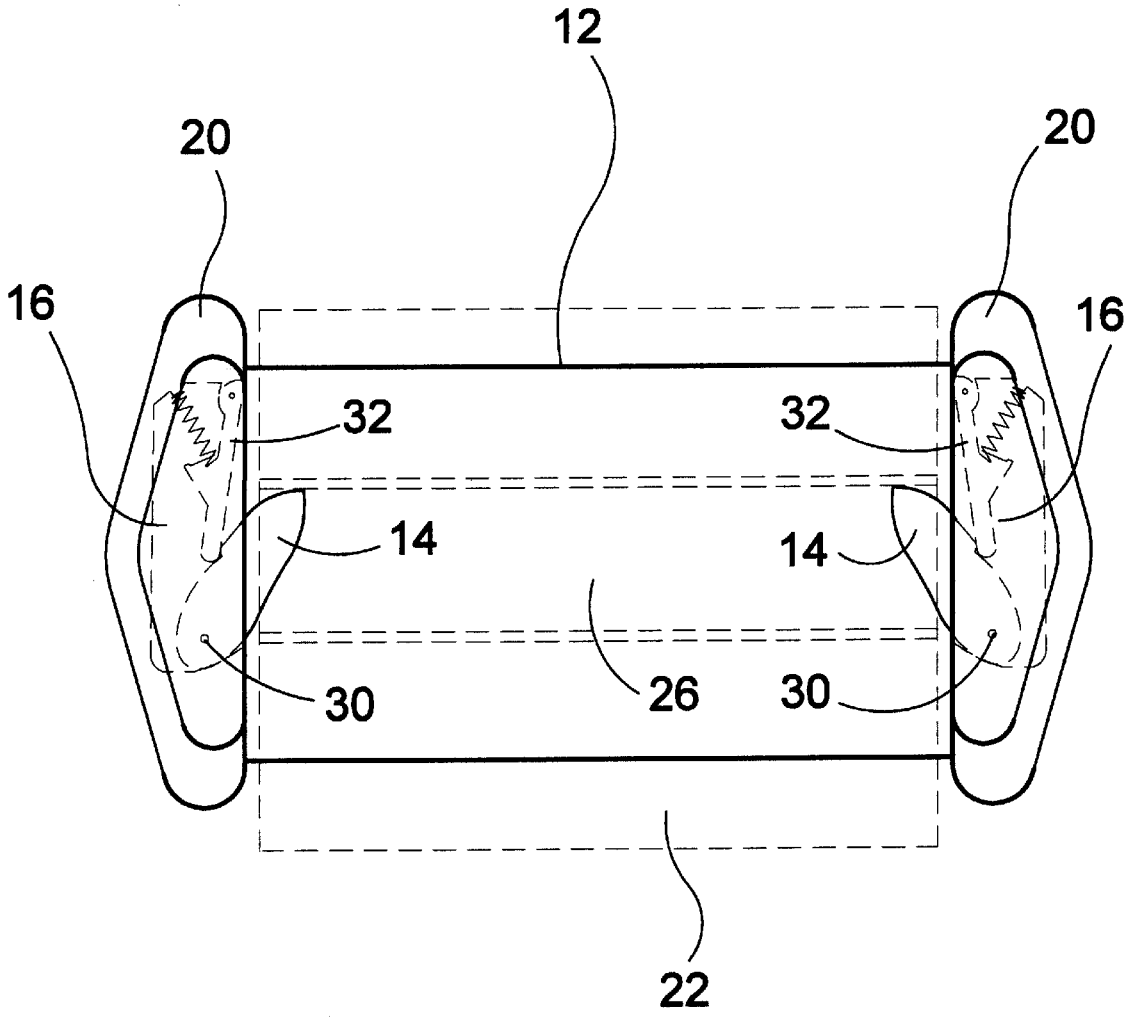
FIG. 7 is a continuation of the installation of a paper roll as shown in FIG. 6. Shown is the sanitary paper dispenser having tensioned pivotal cavity shields which serve the dual purpose of providing tensioning means for the paper roll support arms and closure means for the cavity which exists in mechanisms having pivotal paper roll support arms. As the paper roll is inserted into the dispenser, the paper roll causes the support arms to pivot into a cavity within the dispensers housing until the arms which are under tensioning means, return to the extended position upon encountering the hollow area of the roll. The pivotal cavity shield not only adds to the aesthetic quality of the paper dispenser but will also prevent the introduction of particle matter into said cavity therein providing a sanitary paper roll dispenser.

Turning to FIG. 7, shown therein is a continuation of the installation of a paper roll 22 as shown in FIG. 6. Shown is the sanitary paper dispenser 12 having tensioned pivotal cavity shields 14 which serve the dual purpose of providing the paper roll support arms and closure means for the cavity 16 which exists in mechanisms having pivotal paper roll 22 support arms. As the paper roll is inserted into the dispenser 12, the paper roll causes the support arms 14 to pivot 30 into a cavity 16 within the dispensers housing 20 until the arms 14, which are under tensioning means 32, return to the extended position upon encountering the hollow area 26 of the roll 22. The pivotal cavity shield 14 not only adds to the aesthetic quality of the paper dispenser 12 but will also prevent the introduction of particle matter into the cavity 16 therein providing a sanitary paper roll dispenser.

Figure 8:
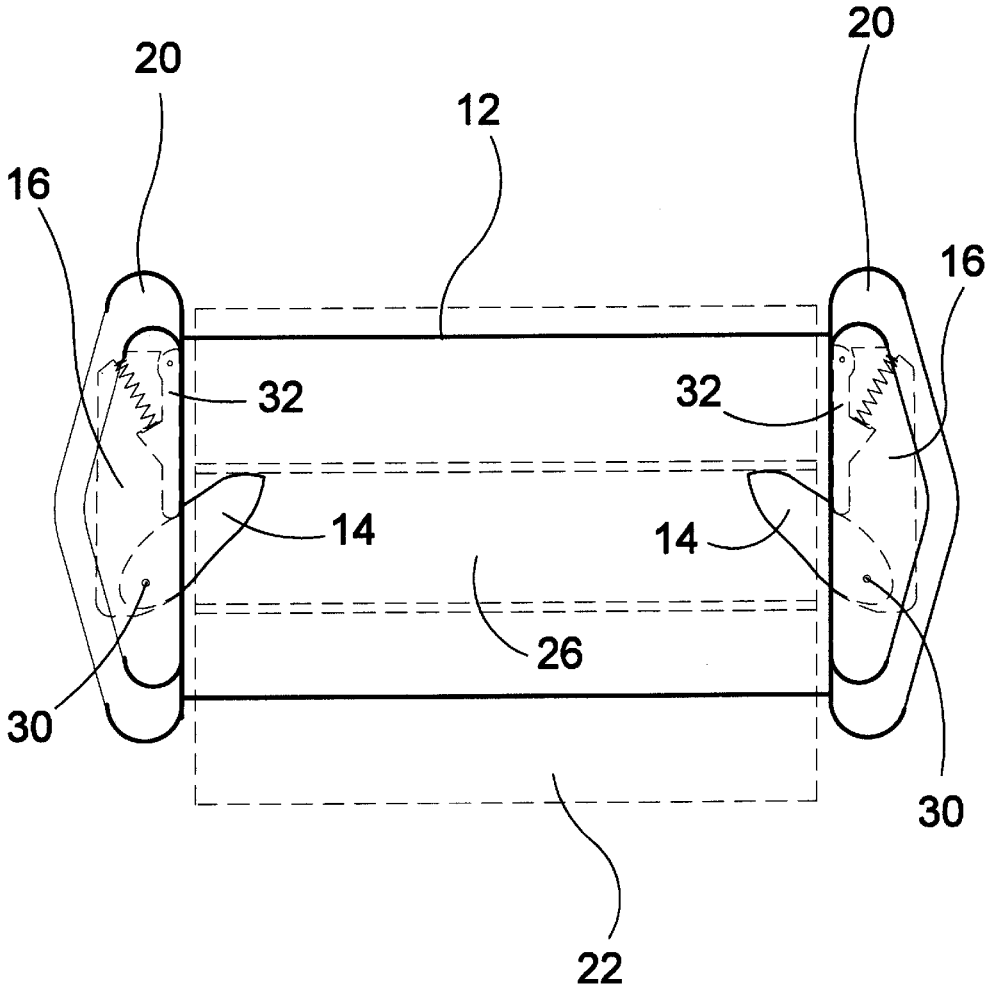
FIG. 8 is a continuation of the installation of a paper roll as shown in FIG. 7. Shown is the sanitary paper dispenser having tensioned pivotal cavity shields which serve the dual purpose of providing tensioning means for the paper roll support arms and closure means for the cavity which exists in mechanisms having pivotal paper roll support arms. As the paper roll is inserted into the dispenser, the paper roll causes the support arms to pivot into a cavity within the dispensers housing until the arms which are under tensioning means, return to the extended position upon encountering the hollow area of the roll. The pivotal cavity shield not only adds to the aesthetic quality of the paper dispenser but will also prevent the introduction of particle matter into said cavity therein providing a sanitary paper roll dispenser.

Turning to FIG. 8, shown therein is a continuation of the installation of a paper roll 22 as shown in FIG. 7. Shown is the sanitary paper dispenser 12 having tensioned pivotal cavity shields 14 which serve the dual purpose of providing the paper roll support arms and closure means for the cavity 16 which exists in mechanisms having pivotal paper roll support arms. As the paper roll 22 is inserted into the dispenser 12, the paper roll causes the support arms 14 to pivot 30 into a cavity 16 within the dispensers housing 20 until the arms, which are under tensioning means 32, return to the extended position upon encountering the hollow area 26 of the roll. The pivotal cavity shield 14 not only adds to the aesthetic quality of the paper dispenser 12 but will also prevent the introduction of particle matter into the cavity 16 therein providing a sanitary paper roll dispenser.

Figure 9:
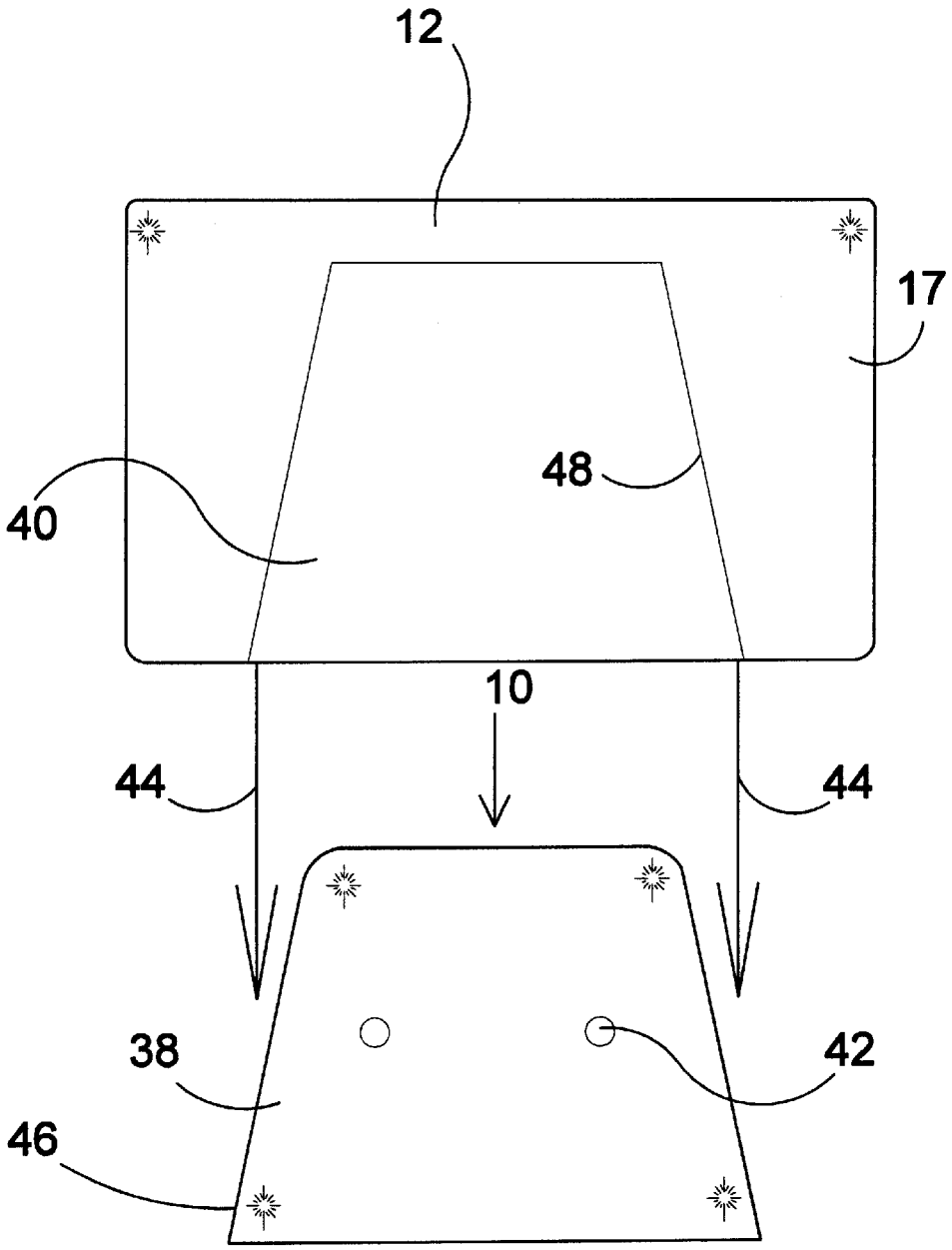
FIG. 9 is a rear view of a typical mounting mechanism for the sanitary paper dispenser. Shown is a plate which is mounted to the wall by any means know within the art. The paper roll dispenser has a cavity within the exterior structure of similar dimensions as the mounting plate whereby the paper roll dispenser slides on said mounting plate as indicated by the arrow.

Turning to FIG. 9, shown therein is a rear view of a typical mounting mechanism for removably attaching the sanitary paper dispenser. Shown is a plate 38 which is mounted to the wall using apertures 42 by any means know within the art. The paper roll dispenser 12 has a cavity 40 within the exterior of its back side 17 of similar dimensions and shape as the mounting plate 38 whereby the back 17 of the paper roll dispenser 12 slides on the mounting plate 38 as indicated by the direction arrow 44 whereby angular edges 46 of plate 38 are received by recess 48.

Figure 10:
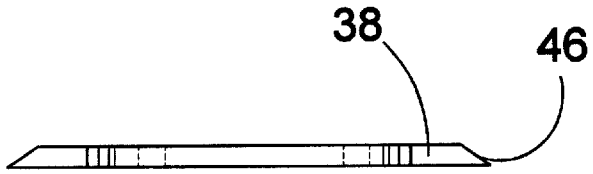
FIG. 10 is an end view of the typical mounting mechanism for the sanitary paper dispenser.

Turning to FIG. 10, shown therein is an end view of the typical mounting plate 38 for the sanitary paper dispenser 12 showing the angular edges 46 which secure the plate 38 to the recess 48 of dispenser 12.

What is claimed to be new and desired to be protected by Letters Patent is set forth in the appended claims:

1. An apparatus for a cavity shield for use on a toilet pager dispenser used for dispensing a roll of conventional toilet paper, the toilet paper dispenser being mounted on the wall of a structure, comprising:

a) a base member for mounting to a wall, said base member defined by a front side, a back side, and a pair of ends;

b) a pair of end members disposed on said ends of said base member, said end members defined by an inner face and an outer face;

c) said end members each having a cavity therein, said cavity having an opening therein on said inner face of said end member;

d) means for providing a cavity shield, whereby said cavity shield provides a shield for said cavity and a support arm for the toilet paper;

e) said base member further comprising means for mounting on a wall whereby the toilet paper dispenser is removably attached to the wall, said mounting means further comprising a mounting plate for attachment to the wall, said mounting plate receiving the toilet paper dispenser; and f) said back side of said toilet paper dispenser having a cavity therein, said cavity for receiving said mounting plate, said cavity having a recess disposed on its edges, said recess for receiving said mounting plate.

2. The apparatus of claim 1, wherein said base member is rectangular in shape.

3. The apparatus of claim 1, said mounting plate further comprising an angular edge, said angular edge for mating with said recess of said cavity of said toilet paper dispenser whereby said mounting plate is secured to said toilet paper dispenser.

4. The apparatus of claim 1, wherein said end members are substantially the same height as said base member.

5. The apparatus of claim 1, wherein said opening of said cavity is rectangular shaped, said opening having its longer edge vertically disposed.

6. The apparatus of claim 5, wherein said means for a cavity shield is complementrally shaped as said opening of said cavity whereby said opening is substantially closed by said cavity shield.

7. The apparatus of claim 6, said cavity shield further comprising a pivot.

8. The apparatus of claim 7, wherein said pivot is disposed on the lower end of said cavity shield.

9. The apparatus of claim 8, said cavity shield further comprising means for outward biasing whereby said cavity shield is biased toward the inside of the toilet paper dispenser.

10. The apparatus of claim 9, said means for outward biasing further comprising a pivot.

11. The apparatus of claim 10, said means for outward biasing further comprising a spring tensioning means.

12. The apparatus of claim 11, wherein said cavity shield is flush with said inner face of said end member when in a first inwardly pivoted position for placement of toilet paper in the toilet paper dispenser.

13. The apparatus of claim 12, wherein said cavity shield protrudes from said inner face of said end members when in a second outwardly pivoted position for holding toilet paper within the toilet paper dispenser.

14. The apparatus of claim 10, said means for outward biasing further comprising a spring.

* * * * *

UNITED STATES PATENT AND TRADEMARK OFFICE

CERTIFICATE OF CORRECTION

PATENT NO. : 6,189,828 B1
DATED : February 20, 2001
INVENTOR(S) : Robert Reilly

It is certified that error appears in the above-identified patent and that said Letters Patent is hereby corrected as shown below:

Column 8,
Line 1, "pager" should be -- paper --.

Signed and Sealed this

Twenty-eighth Day of May, 2002

*Attest:*

*Attesting Officer*

JAMES E. ROGAN
*Director of the United States Patent and Trademark Office*